US007792453B2

(12) United States Patent
Baek et al.

(10) Patent No.: US 7,792,453 B2
(45) Date of Patent: Sep. 7, 2010

(54) IMAGE FORMING APPARATUS WITH OPENING/CLOSING MEMBER

(75) Inventors: Sung Ku Baek, Suwon-si (KR); Sung Hyup Kim, Suwon-si (KR); Sun Soo Kim, Suwon-si (KR); Gyu Deok Hwang, Seoul (KR); Jong Woo Kim, Yongin-si (KR); Hyun Ki Cho, Hanam-si (KR); Je Hyoung Ryu, Seongnam-si (KR); Tae Hee Kim, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/153,271

(22) Filed: May 15, 2008

(65) Prior Publication Data

US 2009/0052924 A1 Feb. 26, 2009

(30) Foreign Application Priority Data

Aug. 21, 2007 (KR) ..... 10-2007-0084104

(51) Int. Cl.
*G03G 15/20* (2006.01)

(52) U.S. Cl. ..... 399/69; 399/92; 399/94

(58) Field of Classification Search ..... 399/67, 399/69, 92, 94

See application file for complete search history.

(56) References Cited

U.S. PATENT DOCUMENTS 4,435,072 A * 3/1984 Adachi et al. ..... 399/336
5,732,309 A * 3/1998 Okuno et al. ..... 399/68
5,787,323 A * 7/1998 Nomura et al. ..... 399/111
6,240,265 B1 * 5/2001 Noh ..... 399/92

FOREIGN PATENT DOCUMENTS

KR 10-2004-0059713 7/2004

* cited by examiner

*Primary Examiner*—David M Gray
*Assistant Examiner*—Barnabas T Fekete
(74) *Attorney, Agent, or Firm*—Staas & Halsey LLP

(57) ABSTRACT

An image forming apparatus capable of minimizing a temperature rise of a cover by substantially preventing heat emission from a fusing device to an outside is disclosed. The image forming apparatus includes a main body, a fusing device mounted in the main body, the fusing device having an outlet to discharge paper, an opening/closing member opening and closing the outlet of the fusing device, a cam member moving the opening/closing member between a first position in which the opening/closing member closes the outlet to prevent heat in the fusing device from being emitted through the outlet and a second position in which the opening/closing member opens the outlet to permit the paper to pass through the outlet, a driving part rotating the cam member, and a control unit controlling the driving part to determine a rotational position of the cam member.

16 Claims, 7 Drawing Sheets

IMAGE FORMING APPARATUS WITH OPENING/CLOSING MEMBER

CROSS-REFERENCE TO RELATED APPLICATIONS

This application claims the benefit of Korean Patent Application No. 2007-0084104, filed on Aug. 21, 2007 in the Korean Intellectual Property Office, the disclosure of which is incorporated herein by reference.

BACKGROUND

1. Field

The present invention relates to an image forming apparatus, and more particularly to an image forming apparatus that can substantially prevent heat emission from a fusing device to an outside.

2. Description of the Related Art

An image forming apparatus is an apparatus that prints an image on a printing medium, e.g., paper, according to an inputted image signal. As one type of image forming apparatus, an electrophotographic type image forming apparatus is configured such that light is scanned to a photosensitive body charged with a predetermined electric potential to form an electrostatic latent image on an outer peripheral surface of the photosensitive body. The electrostatic latent image is developed into a toner image by supplying a toner to the electrostatic latent image, and the toner image is transferred onto paper.

The toner image transferred onto the paper is just carried on the paper, but is not fused to the paper. Therefore, an image forming apparatus includes a fusing device to fuse the transferred toner image to the paper. The fusing device generally includes a heating roller having a heat source therein, and a press roller in close contact with the heating roller to form a fusing nip at a contact portion with the heating roller. If the toner image transferred paper passes between the rotating heating roller and the press roller, the toner image is fused to the paper by heat transferred from an interior of the heating roller and pressure generated between the heating roller and the press roller.

The image forming apparatus is provided with a cover above the fusing device to permit a user to obtain access to an interior of a main body of the image forming apparatus when intending to inspect the interior of the main body or remove jammed paper from the fusing device.

The heat generated from the heating roller mounted in the fusing device is transferred to the cover mounted above the fusing device by radiation, conduction and convection phenomena. Because a user frequently touches the cover whenever inspecting the interior of the apparatus, if the cover becomes hot by the heat transferred from the fusing device, it gives the user an unpleasant feeling when touching the cover.

To solve this problem, Korean Patent Registration No. 0463273 discloses an image forming apparatus having a heat shielding member mounted between a fusing device and a cover. The heat shielding member intercepts the heat transferred from the fusing device from reaching the cover by reflecting the heat, thereby preventing a temperature rise of the cover.

The above heat shielding member can temporarily intercept the heat emitted from the fusing device from being transferred to the cover, but there is a limitation in maintaining a temperature of the cover low only by the heat shielding member in a circumstance in which the fusing device continuously emits heat.

SUMMARY

Therefore, it is an aspect of the embodiment to provide an image forming apparatus that can minimize a temperature rise of a cover by substantially preventing heat emission from a fusing device to an outside.

Additional aspects and/or advantages will be set forth in part in the description which follows and, in part, will be obvious from the description, or may be learned by practice of the invention.

The foregoing and/or other aspects are achieved by providing an image forming apparatus, including: a main body; a fusing device mounted in the main body, the fusing device having an outlet to discharge paper; an opening/closing member opening and closing the outlet of the fusing device; a cam member moving the opening/closing member between a first position in which the opening/closing member closes the outlet to prevent heat in the fusing device from being emitted through the outlet and a second position in which the opening/closing member opens the outlet to permit the paper to pass through the outlet; a driving part rotating the cam member; and a control unit controlling the driving part to determine a rotational position of the cam member.

The image forming apparatus may further include a cover mounted above the fusing device opening and closing a portion of the main body.

The driving part may include a driving source and a power intermittence unit intermitting power transmitted from the driving source to the cam member. The power intermittence unit may be configured as an electronic clutch.

The image forming apparatus may further include a first paper sensor to sense a front end of the paper advancing into the fusing device. When the front end of the paper is sensed by the first paper sensor, the control unit may rotate the cam member to move the opening/closing member from the first position to the second position.

The image forming apparatus may further include a second paper sensor to sense a rear end of the paper having passed through the fusing device. When the rear end of the paper is sensed by the second paper sensor, the control unit may rotate the cam member to move the opening/closing member from the second position to the first position. The opening/closing member may move from the second position to the first position by its own weight.

The foregoing and/or other aspects are achieved by providing an image forming apparatus, including: a main body; a cover opening and closing a portion of the main body; a fusing device mounted below the cover, the fusing device having an outlet to discharge paper; an opening/closing member provided movably between a first position in which the opening/closing member closes the outlet and a second position in which the opening/closing member opens the outlet to permit the paper to pass through the outlet; at least one paper sensor to sense a position of the paper; and a driving device moving the opening/closing member between the first position and the second position.

The driving device may include a cam member moving the opening/closing member from the first position to the second position by pushing up the opening/closing member.

The driving device may further include a driving source and an electronic clutch intermitting power transmitted from the driving source to the cam member.

The at least one paper sensor may include a first paper sensor mounted in an inlet of the fusing device, and a second paper sensor mounted in the outlet of the fusing device.

When the first paper sensor senses a front end of the paper, the driving device may move the opening/closing member to the second position. When the second paper sensor senses a rear end of the paper, the opening/closing member may move from the second position to the first position.

The foregoing and/or other aspects are achieved by providing an image forming apparatus, including: a paper feeding device feeding paper through the image forming apparatus; a developing device developing images onto the paper fed by the paper feeding device; a fusing device fusing the developed images onto the paper and including an outlet; and an opening/closing member opening and closing the outlet of the fusing device.

The image forming apparatus may include at least one paper sensor sensing an end of the paper, wherein the opening/closing member may open or close the outlet of the fusing device based on a result of the sensing the end of the paper.

The at least one paper sensor may include a first sensor sensing a front end of the paper entering the fusing device at an inlet of the fusing device and a second sensor sensing a rear end of the paper leaving the fusing device at the outlet of the fusing device, and wherein the opening/closing member may open the outlet of the fusing device when the first sensor senses that the front end of the paper enters the fusing device and close the outlet of the fusing device when the second sensor senses that the rear end of the paper leaves the fusing device.

The fusing device may include a paper guide adjacent to the outlet of the fusing device, the opening/closing member may have an inclined end portion, and the inclined end portion of the opening/closing member may contact a guide surface of the paper guide to prevent heat from leaking out of the fusing device.

The image forming apparatus may include a cam member proximate to the opening/closing member rotating to cause the opening/closing member to open or close based on the result of the sensing the end of the paper.

The foregoing and/or other aspects are achieved by providing a fusing device of an image forming apparatus, including: a plurality of rollers causing a toner image to fuse to paper fed into the fusing device by applying heat and pressure to the paper; at least one paper sensor sensing an end of paper being fed into or out of the fusing device; and an opening/closing member opening and closing the outlet of the fusing device based on a result of the sensing the end of the paper.

The at least one paper sensor may include a first sensor sensing a front end of the paper entering the fusing device at an inlet of the fusing device and a second sensor sensing a rear end of the paper leaving the fusing device at the outlet of the fusing device, and wherein the opening/closing member may open the outlet of the fusing device when the first sensor senses that the front end of the paper enters the fusing device and close the outlet of the fusing device when the second sensor senses that the rear end of the paper leaves the fusing device.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
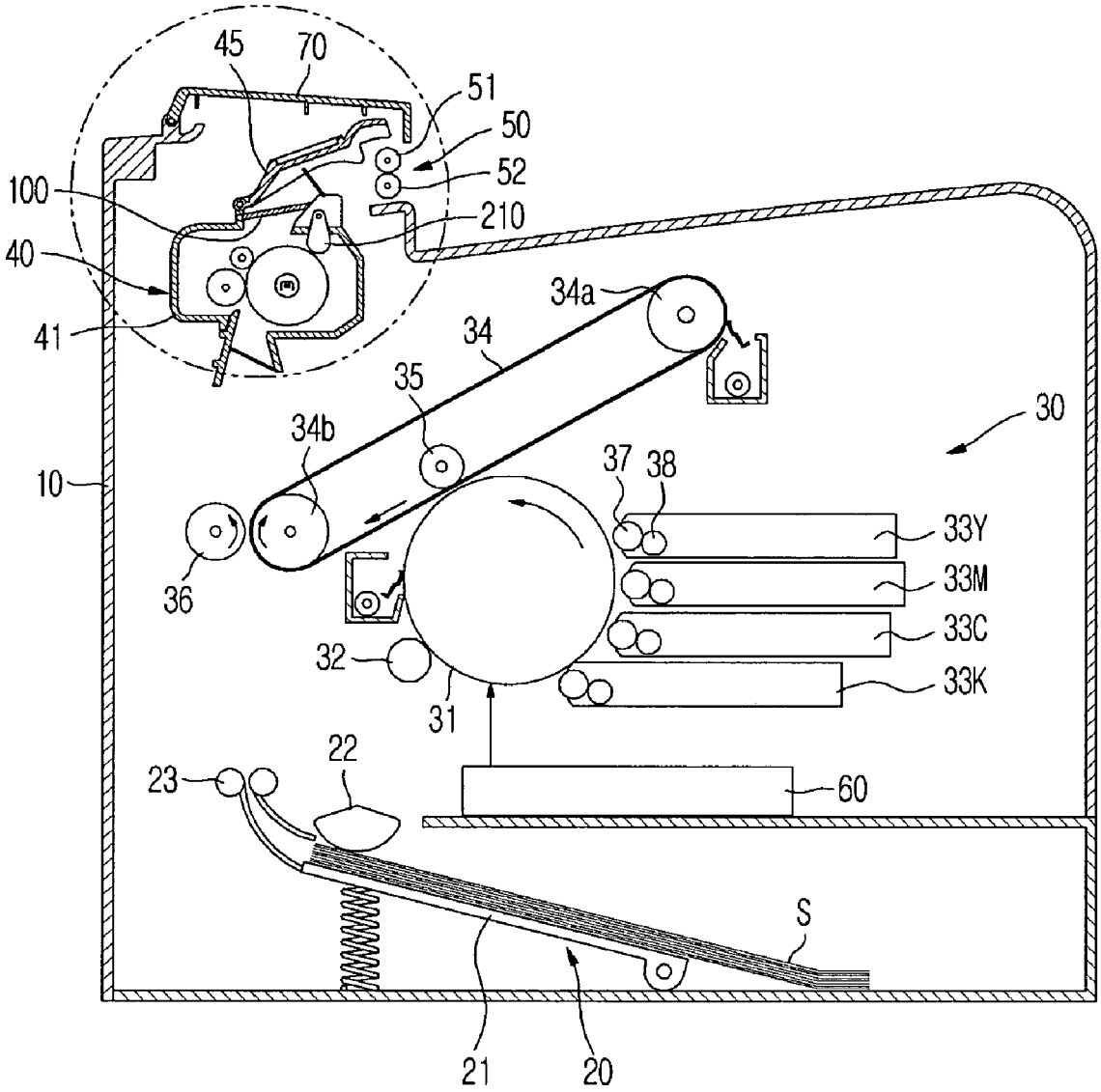
FIG. 1 is a sectional view illustrating a constitution of an image forming apparatus in accordance with the present embodiment.

Reference will now be made in detail to an embodiment, examples of which are illustrated in the accompanying drawings, wherein like reference numerals refer to like elements throughout. The embodiment is described below to explain the present invention by referring to the figures.

Figure 2:
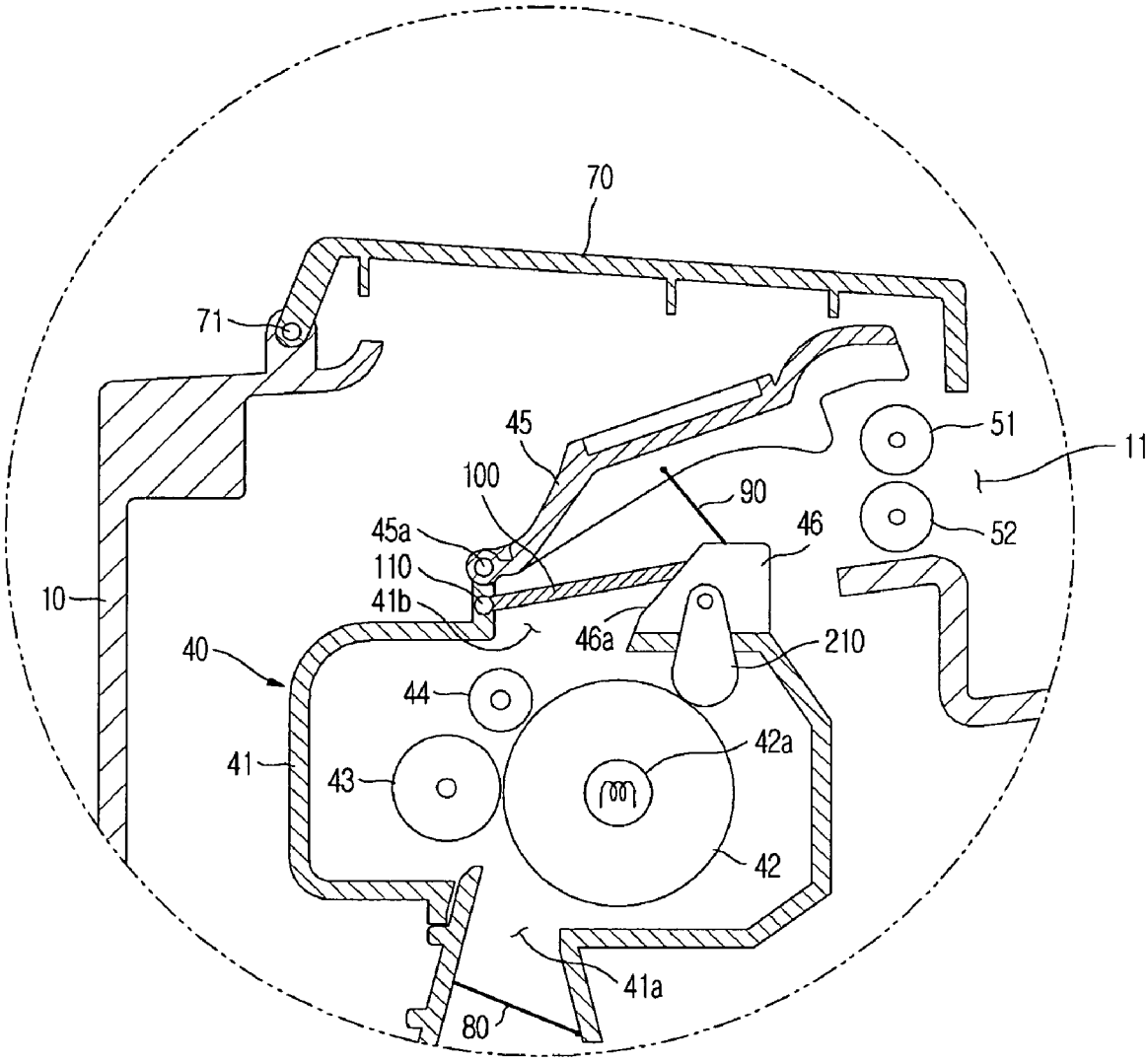
FIG. 2 is an enlarged view of a portion of the image forming apparatus shown in FIG. 1.
Figure 3:
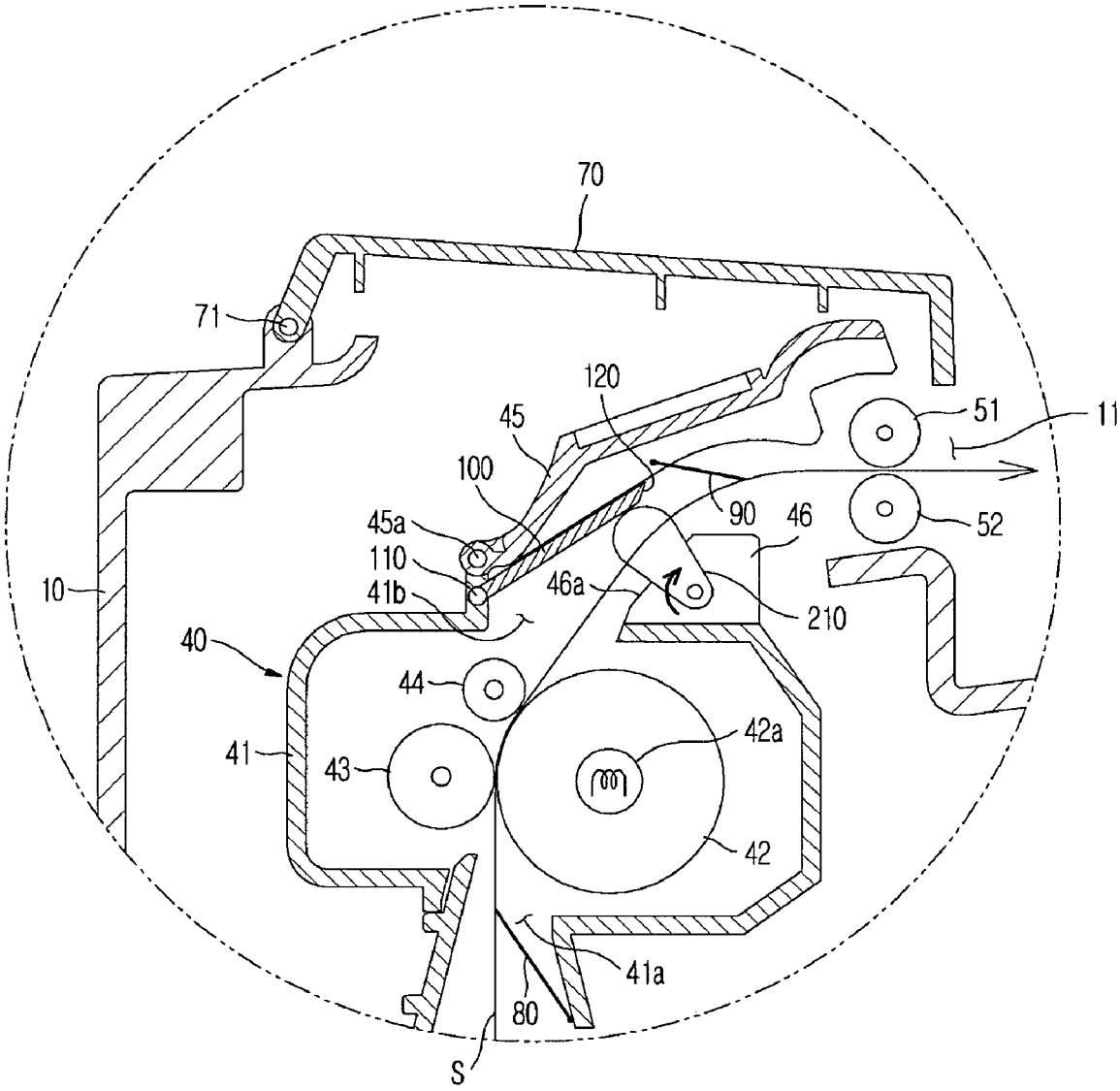
FIG. 3 is a view illustrating a state in which an opening/closing member pivots by a cam member to open an outlet of a fusing device in FIG. 2.

FIG. 1 is a sectional view illustrating a constitution of an image forming apparatus in accordance with the present embodiment, and FIG. 2 is an enlarged view of a portion of the image forming apparatus shown in FIG. 1. FIG. 3 is a view illustrating a state in which an opening/closing member pivots by a cam member to open an outlet of a fusing device in FIG. 2.

As shown in FIG. 1, an image forming apparatus according to the present embodiment includes a main body 10 forming an exterior appearance, a paper feeding device 20 to supply a printing medium, i.e., paper S, a developing device 30 to develop an image on the paper, a fusing device 40 to fuse an image to the paper by applying heat and pressure to the paper, and a paper discharge device 50 to discharge the printed paper to an exterior of the main body 10.

The paper feeding device 20 includes a paper feeding tray 21 to load the paper S thereon, a pickup roller 22 to pick up the paper S on the paper feeding tray 21 sheet by sheet, and a feeding roller 23 to feed the picked-up paper toward the developing device 30.

The developing device 30 includes a photosensitive body 31 on which an electrostatic latent image is formed by a laser scanning unit 60, a charge roller 32 to charge the photosensitive body 31, four developing cartridges 33Y, 33M, 33C and 33K to develop the electrostatic latent image formed on the photosensitive body 31 into a toner image by using toners of yellow, magenta, cyan and black, an intermediate transfer belt 34, a first transfer roller 35, and a second transfer roller 36.

Each of the developing cartridges 33Y, 33M, 33C and 33K include a developing roller 37 to develop the electrostatic latent image formed on the photosensitive body 31 by supplying the toner thereto, and a supply roller 38 to supply the toner to the developing roller 37 by rotating while contacting the developing roller 37.

The intermediate transfer belt 34 is supported by support rollers 34*a* and 34*b*, and runs at the same velocity as a rotational linear velocity of the photosensitive body 31. The first transfer roller 35 opposes the photosensitive body 31, and transfers the toner image developed on the photosensitive body 31 onto the intermediate transfer belt 34. The second transfer roller 36 opposes the intermediate transfer belt 34. While the toner image is transferred onto the intermediate transfer belt 34 from the photosensitive body 31, the second transfer roller 36 is spaced apart from the intermediate transfer belt 34. When the toner image is completely transferred onto the intermediate transfer belt 34, the second transfer roller 36 is moved into contact with the intermediate transfer belt 34 with a predetermined pressure.

The fusing device 40 fuses the toner image to the paper by applying heat and pressure to the paper. As shown in FIGS. 1 to 3, the fusing device 40 includes a frame 41 having an inlet 41*a* to introduce the paper into the frame 41 and an outlet 41*b* to discharge the paper from the frame 41. Inside the frame 41 are mounted a heating roller 42 having a heat source 42*a* to heat the toner image-transferred paper, and two press rollers 43 and 44 in close contact with the heating roller 42 to maintain a constant fusing pressure with the heating roller 42.

A first paper guide 45 and a second paper guide 46 are mounted near the outlet 41*b* of the fusing device 40. The first paper guide 45 and the second paper guide 46 guide the paper passing through the fusing device 40 to smoothly move the paper toward a paper discharge port 11 formed at a portion of the main body 10. One end of the first paper guide 45 is hingedly coupled to the frame 41 of the fusing device 40 by a hinge shaft 45*a*, and the other end of the first paper guide 45 extends toward the paper discharge port 11. The second paper guide 46 is mounted opposite to the first paper guide 45 over the outlet 41*b* of the fusing device 40. The second paper guide 46 has a guide surface 46*a* to guide the movement of the paper.

A cover 70 is mounted above the fusing device 40 to open and close a portion of the main body 10. The cover 70 is hingedly coupled to the main body 10 by a hinge shaft 71. When intending to remove jammed paper from the main body 10 or inspect internal components, a user pulls the cover 70 to open a portion of the main body 10 and can observe the interior of the main body 10 or take appropriate measures.

The paper discharge device 50 includes a discharge roller 51 to discharge the paper passing through the fusing device 40 to the outside of the main body 10, and a discharge backup roller 52 mounted while opposing the discharge roller 51.

The operation of the above-structured image forming apparatus will now be explained briefly with reference to FIGS. 1 to 3. The laser scanning unit 60 irradiates light, for example, corresponding to yellow image information to the photosensitive body 31 charged with a uniform electric potential by the charge roller 32, and an electrostatic latent image corresponding to the yellow image is formed on the photosensitive body 31. A developing bias is applied to the developing roller 37 of the yellow developing cartridge 33Y, and the yellow toner is attached to the electrostatic latent image to develop the electrostatic latent image into a yellow toner image on the photosensitive body 31. The toner image is transferred onto the intermediate transfer belt 34 by the first transfer roller 35.

After the yellow toner image corresponding to one page is completely transferred, the toner images of magenta, cyan and black are sequentially transferred onto the intermediate transfer belt 34 through the same procedures as above. Accordingly, a color toner image is formed on the intermediate transfer belt 34 by the toner images of yellow, magenta, cyan and black being overlapped. The color toner image is transferred onto the paper S passing between the intermediate transfer belt 34 and the second transfer roller 36. The image transferred onto the paper is fused to the paper while passing through the fusing device 40, by heat transferred from the heating roller 42 and pressure generated between the heating roller 42 and the press rollers 43 and 44. The paper having passed through the fusing device 40 is discharged to the outside of the main body 10 by the discharge roller 51.

In the above process, if heat from the interior of the fusing device 40 is continuously emitted through the outlet 41*b* of the frame 41, a temperature of the first paper guide 45 mounted above the outlet 41*b* and a temperature of the cover 70 rise, which gives a user an unpleasant feeling when the user touches the cover 70 and the first paper guide 45 to inspect the interior of the apparatus.

To cope with this problem, the image forming apparatus according to the present embodiment includes an opening/closing member 100 to open and close the outlet 41*b* of the fusing device 40, a driving device 200 (refer to FIG. 4) to drive the opening/closing member 100 so that the opening/closing member 100 can move between a first position in which the opening/closing member 100 closes the outlet 41*b* (refer to FIG. 2) and a second position in which the opening/closing member 100 opens the outlet 41*b* (refer to FIG. 3), and a control unit 300 (refer to FIG. 4) to control the driving device 200 so that the opening/closing member 100 can move at an appropriate point of time.

The opening/closing member 100 opens the outlet 41*b* of the fusing device 40 only when the paper S passes through the outlet 41*b* during the printing operation, and closes the outlet 41*b* anytime else, thereby preventing the heat from the interior of the fusing device 40 from being transferred to the cover 70 through the outlet 41*b*.

As shown in FIGS. 2 and 3, the opening/closing member 100 is hingedly coupled to the frame 41 at one end portion by a hinge shaft 110. Therefore, the other end portion of the opening/closing member 100 can pivot in an up/down direction on the hinge shaft 110 and can move between the first position and the second position. When the opening/closing member 100 is located at the first position to close the outlet 41*b* of the fusing device 40, the other end portion of the opening/closing member 100 extends across the outlet 41*b* and is supported by the second paper guide 46. The other end portion of the opening/closing member 100 has an inclined portion 120 (shown in FIG. 3) which is inclined along the guide surface 46*a* of the second paper guide 46. By the inclined portion 120 being closely contacted with the guide surface 46*a* of the second paper guide 46, the heat in the fusing device 40 does not leak.

It is preferred that the opening/closing member 100 is made of a material having an excellent thermal insulation property. Although not illustrated in FIGS. 2 and 3, it is possible to install an additional thermal insulation member inside the opening/closing member.

Figure 4:
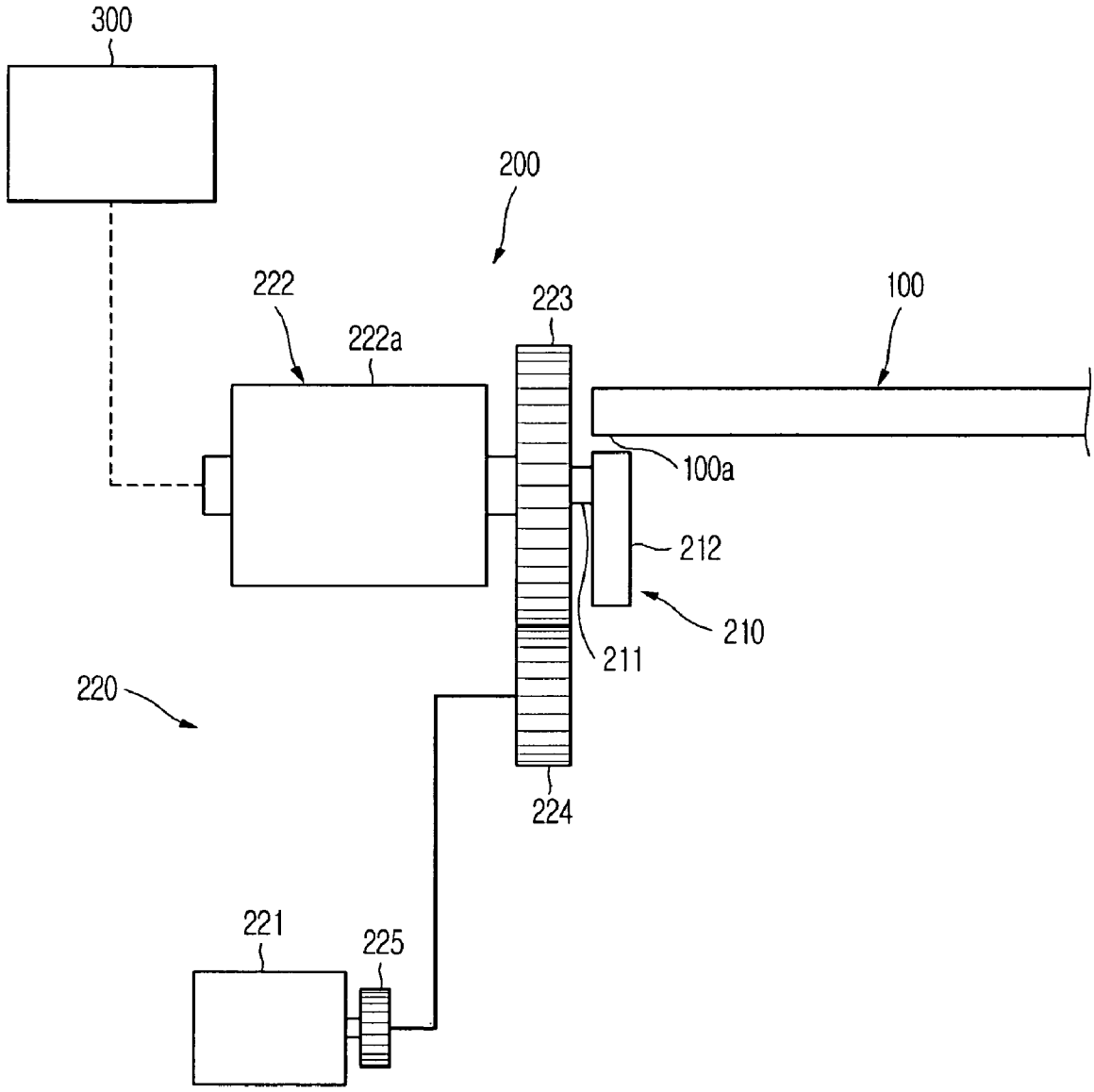
FIG. 4 is a view illustrating a constitution of a driving device to drive the opening/closing member in the image forming apparatus in accordance with the present embodiment.

FIG. 4 is a view illustrating the constitution of the driving device to drive the opening/closing member in the image forming apparatus according to the present embodiment. As shown in FIGS. 2 to 4, the driving device 200 includes a cam member 210 to move the opening/closing member 100 between the first position and the second position, and a driving part 220 to rotation-drive the cam member 210.

The cam member 210 has a cam shaft 211 and a rotating cam 212 provided at an end portion of the cam shaft 211. During the rotation, the rotating cam 212 interferes with an end portion 100*a* in a side direction of the opening/closing member 100 at a specific region, and pushes up the opening/closing member 100. Therefore, the opening/closing member 100 pivots from the first position to the second position, and opens the outlet 41*b* of the fusing device 40 as shown in FIG. 3. On the other hand, if the rotating cam 212 rotates more from the state shown in FIG. 3 and is separated from the opening/closing member 100, the opening/closing member 100 pivots downward by its own weight to the first position, and closes the outlet 41*b* of the fusing device 40 as shown in FIG. 2.

The driving part 220 to drive the cam member 210 includes a driving motor 221 as a driving source, and a power intermittence unit 222 to intermit the power transmitted from the driving motor 221 to the cam member 210. In this embodiment, the power intermittence unit 222 is configured as an electronic clutch 222*a*, however the embodiment is not restricted thereto. Various types of clutch devices can be applied to the power intermittence unit 222.

The electronic clutch 222*a* is connected with a clutch gear 223 and the cam member 210. The clutch gear 223 is connected to the driving motor 221 through a gear train (only two gears 224 and 225 of the gear train are illustrated in FIG. 4 for convenience of illustration). When the electronic clutch 222*a* is turned ON, a rotational force of the clutch gear 223 is transmitted to the cam member 210. When the electronic clutch 222*a* is turned OFF, the rotational force of the clutch gear 223 is not transmitted to the cam member 210. Although FIG. 4 illustrates that the electronic clutch 222*a* is directly connected with the cam member 210, it is also possible to install a series of power transmission gears between the electronic clutch 222*a* and the cam member 210.

As shown in FIGS. 2 and 3, the image forming apparatus of the present embodiment includes a first paper sensor 80 mounted in the inlet 41*a* of the fusing device 40, and a second paper sensor 90 mounted in the outlet 41*b* of the fusing device 40.

When the first paper sensor 80 senses a front end of the paper, the control unit 300 determines that the paper is advancing into the fusing device 40, and accordingly controls the driving device 200 so that the opening/closing member 100 opens the outlet 41*b* of the fusing device 40. Also when the second paper sensor 90 senses a rear end of the paper, the control unit 300 determines that the paper has completely passed through the fusing device 40, and accordingly controls the driving device 200 so that the opening/closing member 100 closes the outlet 41*b* of the fusing device 40.

Hereinafter, the operation of opening and closing the outlet of the fusing device by the opening/closing member in the image forming apparatus according to the present embodiment will be explained in detail with reference to FIGS. 3 to 5A-C.

Figure 5A:
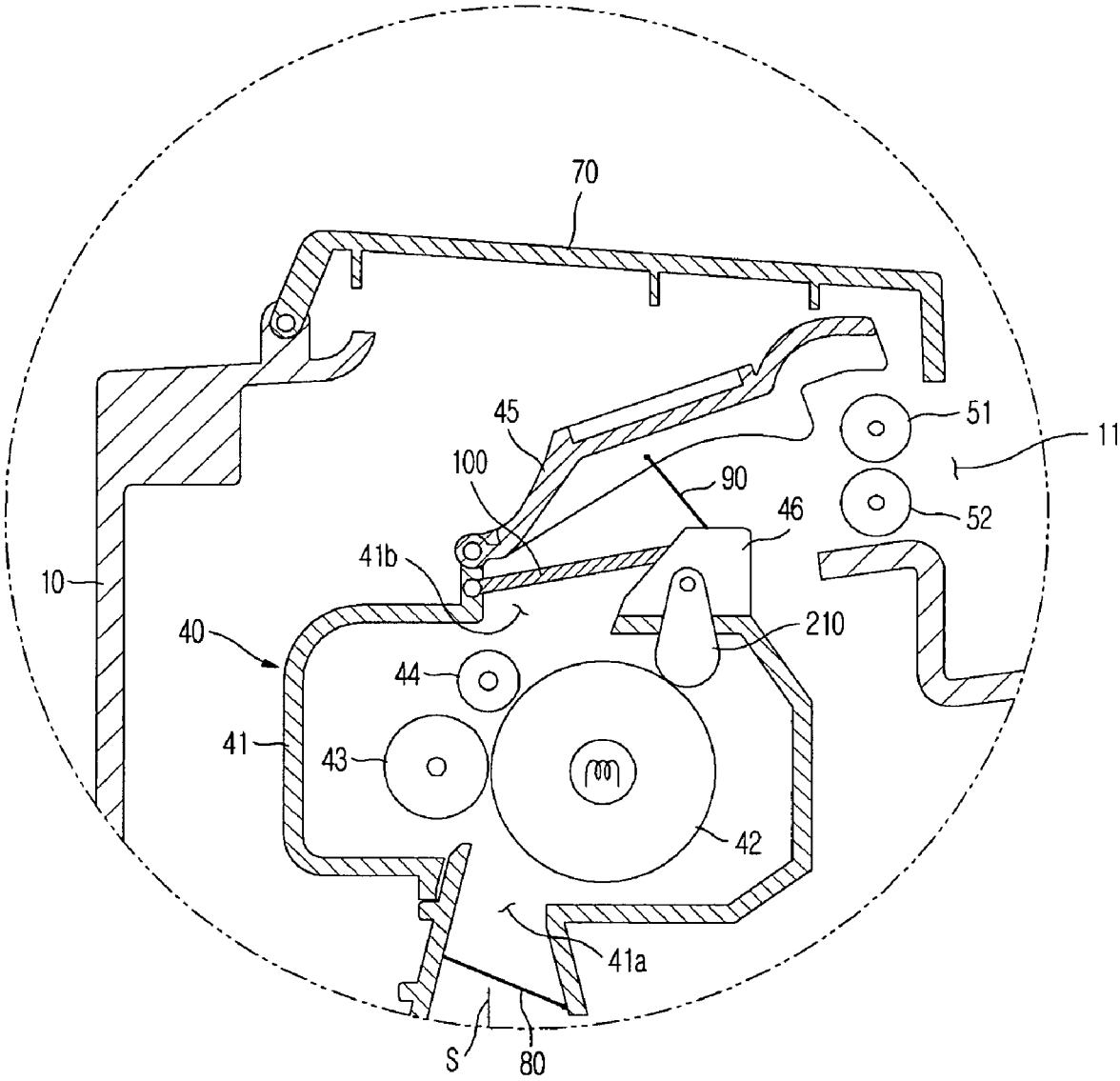
FIG. 5 is a view for explaining an operation of opening and closing the outlet of the fusing device by the opening/closing member in the image forming apparatus in accordance with the present embodiment.

While the paper fed in the main body 10 passes between the intermediate transfer belt 34 and the second transfer roller 36, an image is printed on the paper. The printed paper S, as shown in FIG. 5A, starts advancing into the fusing device 40. FIG. 5A shows a state in which the paper is positioned close to the first paper sensor 80. When the front end of the paper is not sensed by the first paper sensor 80, the opening/closing member 100 is positioned in the first position and keeps closing the outlet 41*b* of the fusing device 40. Accordingly, the heat in the fusing device 40 is not transferred to the cover 70.

Figure 5B:
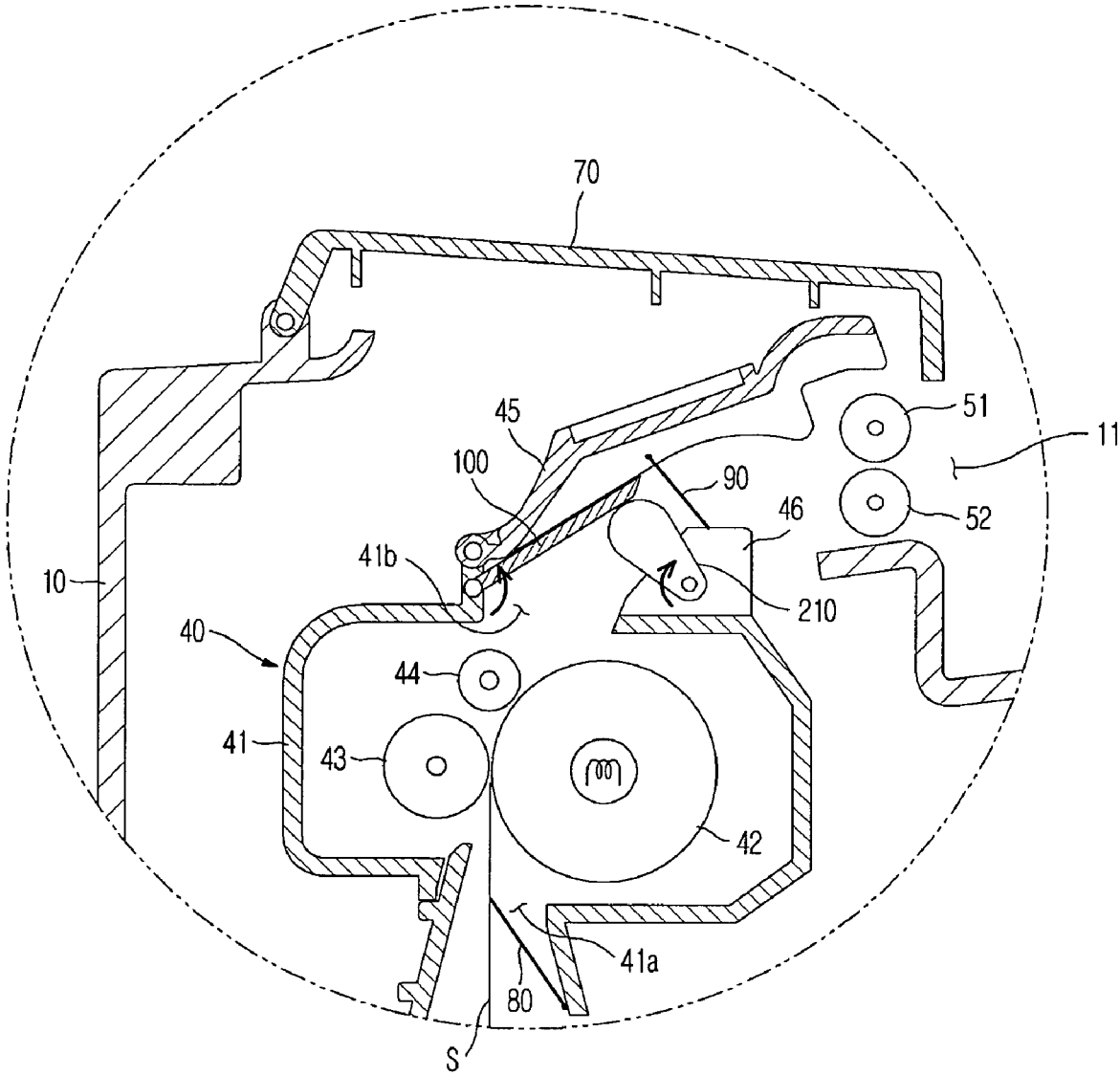

When the paper S is fed more from the state shown in FIG. 5A and the front end of the paper S operates the first paper sensor 80 as shown in FIG. 5B, the control unit 300 determines that the paper is advancing into the fusing device 40, and accordingly controls the electronic clutch 222*a* of the driving device 200 so that the opening/closing member 100 opens the outlet 41*b* of the fusing device 40. In other words, the control unit 300 turns ON the electronic clutch 222*a* for a predetermined time. Only while the electronic clutch 222*a* is in the ON state, the power of the driving motor 221 is transmitted to the cam member 210 to rotate the cam member 210 at a predetermined angle, and the rotating cam 212 of the cam member 210 interferes with the opening/closing member 100 to push up the opening/closing member 100 as shown in FIG. 5B. As a result, the outlet 41*b* of the fusing device 40 is opened.

When the outlet 41*b* of the fusing device 40 is opened as shown in FIG. 5B, the paper S is fed toward the discharge roller 51 via the outlet 41*b*. At this time, the front end of the paper fed toward the discharge roller 51 operates the second paper sensor 90 as shown in FIG. 3.

Figure 5C:
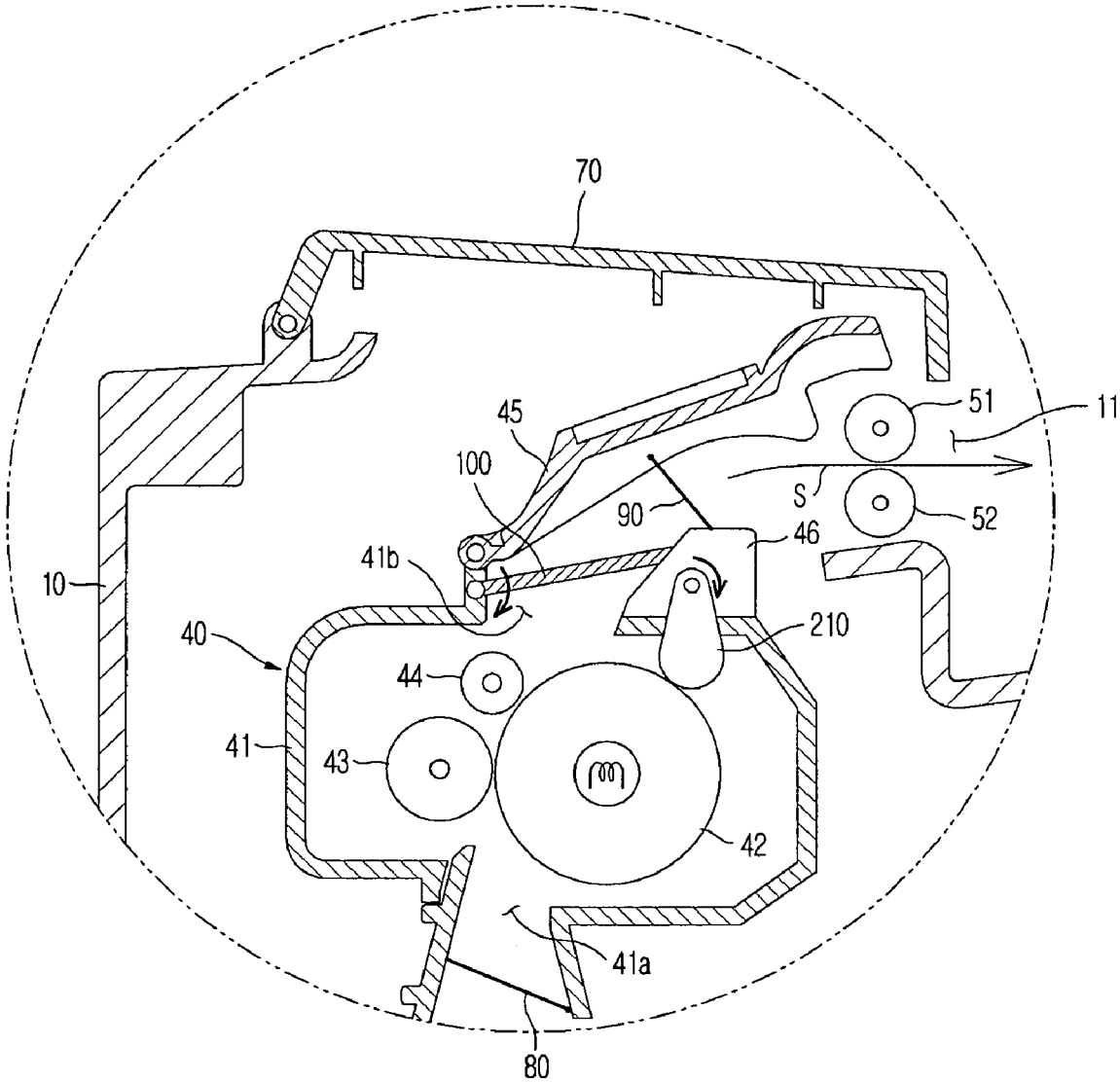

As shown in FIG. 5C, when the rear end of the fed paper S passes away from the second paper sensor 90, the second paper sensor 90 is returned to its original position. In response to the movement of the second paper sensor 90, the control unit 300 turns ON the electronic clutch 222*a* for a predetermined time. When the electronic clutch 222*a* is turned ON, the power of the driving motor 221 is transmitted to the cam member 210 through the electronic clutch 222*a*, and accordingly the cam member 210 is returned to its original position. When the cam member 210 is returned to its original position as shown in FIG. 5C, the opening/closing member 100 pivots downward by its own weight and closes the outlet 41*b* of the fusing device 40.

Since the opening/closing member 100 keeps closing the outlet 41*b* of the fusing device 40 until the following sheet of paper is introduced into the fusing device 40, the heat in the fusing device 40 is intercepted by the opening/closing member 100, and thus cannot be emitted to the outside through the outlet 41*b*. As a result, a rise of a temperature of the first paper guide 45 disposed above the fusing device 40 or a temperature of the cover 70 can be minimized.

As apparent from the above description, the image forming apparatus according to the present embodiment can minimize the heat emission from the fusing device to the outside of the fusing device, because the outlet of the fusing device is opened only when needed. Accordingly, a temperature rise of the components arranged near the fusing device can be minimized.

Further, since heat loss from the interior of the fusing device to the exterior is reduced, a fusing temperature can be efficiently maintained at an appropriate level.

Although an embodiment has been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a main body;

a fusing device mounted in the main body, the fusing device including a frame having an inlet to introduce the paper into the frame and an outlet to discharge the paper from the frame;

a first paper guide hingedly coupled to the frame adjacent to the outlet;

a second paper guide mounted opposite to the first paper guide over the outlet;

an opening/closing member opening and closing the outlet of the fusing device, the opening/closing member hingedly coupled to the frame at one end portion by a hinge shaft and being contacted with the second paper guide at the other end portion;

a cam member moving the opening/closing member between a first position in which the opening/closing member closes the outlet to prevent heat in the fusing device from being emitted through the outlet and a second position in which the opening/closing member opens the outlet to permit the paper to pass through the outlet;

a driving part rotating the cam member;

a control unit controlling the driving part to determine a rotational position of the cam member;

a first sensor sensing a front end of the paper entering the fusing device at the inlet of the fusing device; and a second sensor sensing a rear end of the paper leaving the fusing device at the outlet of the fusing device;

wherein the opening/closing member opens the outlet of the fusing device when the first sensor senses that the front end of the paper enters the fusing device and closes the outlet of the fusing device when the second sensor senses that the rear end of the paper leaves the fusing device.

2. The image forming apparatus according to claim 1, further comprising:

a cover mounted above the fusing device opening and closing a portion of the main body.

3. The image forming apparatus according to claim 1, wherein the driving part includes a driving source and a power intermittence unit intermitting power transmitted from the driving source to the cam member.

4. The image forming apparatus according to claim 3, wherein the power intermittence unit includes an electronic clutch.

5. The image forming apparatus according to claim 1, wherein the control unit rotates the cam member to move the opening/closing member from the first position to the second position when the front end of the paper is sensed by the first paper sensor.

6. The image forming apparatus according to claim 1, wherein the control unit rotates the cam member to move the opening/closing member from the second position to the first position when the rear end of the paper is sensed by the second paper sensor.

7. The image forming apparatus according to claim 6, wherein the opening/closing member moves from the second position to the first position by its own weight.

8. An image forming apparatus, comprising:

a main body;

a cover opening and closing a portion of the main body;

a fusing device mounted below the cover, the fusing device including a frame having an inlet to introduce the paper into the frame and an outlet to discharge the paper from the frame;

a first paper guide hingedlv coupled to the frame adjacent to the outlet;

a second paper guide mounted opposite to the first paper guide over the outlet;

an opening/closing member provided movably between a first position in which the opening/closing member closes the outlet and a second position in which the opening/closing member opens the outlet to permit the paper to pass through the outlet, the opening/closing member hingedly coupled to the frame at one end portion by a hinge shaft and being contacted with the second paper guide at the other end portion;

at least one paper sensor to sense a position of the paper; and a driving device moving the opening/closing member between the first position and the second position based on an input from the at least one paper sensor, wherein the at least one paper sensor includes a first sensor sensing a front end of the paper entering the fusing device at the inlet of the fusing device and a second sensor sensing a rear end of the paper leaving the fusing device at the outlet of the fusing device, and wherein the opening/closing member opens the outlet of the fusing device when the first sensor senses that the front end of the paper enters the fusing device and closes the outlet of the fusing device when the second sensor senses that the rear end of the paper leaves the fusing device.

9. The image forming apparatus according to claim 8, wherein the driving device includes a cam member moving the opening/closing member from the first position to the second position by pushing up the opening/closing member.

10. The image forming apparatus according to claim 9, wherein the driving device further includes a driving source and an electronic clutch intermitting power transmitted from the driving source to the cam member.

11. The image forming apparatus according to claim 8, wherein the driving device moves the opening/closing member to the second position when the first paper sensor senses a front end of the paper.

12. The image forming apparatus according to claim 8, wherein the opening/closing member moves from the second position to the first position when the second paper sensor senses a rear end of the paper.

13. An image forming apparatus, comprising:

a paper feeding device feeding paper through the image forming apparatus;

a developing device developing images onto the paper fed by the paper feeding device;

a fusing device fusing the developed images onto the paper and including a frame having an inlet to introduce the paper into the frame and an outlet to discharge the paper from the frame;

a first paper guide hingedly coupled to the frame adjacent to the outlet;

a second paper guide mounted opposite to the first paper guide over the outlet; and an opening/closing member opening and closing the outlet of the fusing device, the opening/closing member hingedly coupled to the frame at one end portion by a hinge shaft and being contacted with the second paper guide at the other end portion;

wherein the fusing device includes a paper guide adjacent to the outlet of the fusing device, the opening/closing member has an inclined end portion, and the inclined end portion of the opening/closing member contacts a guide surface of the paper guide to prevent heat from leaking out of the fusing device.

14. The image forming apparatus according to claim 13, further comprising at least one paper sensor sensing an end of the paper, wherein the opening/closing member opens or closes the outlet of the fusing device based on a result of the sensing the end of the paper.

15. The image forming apparatus according to claim 14, wherein the at least one paper sensor includes a first sensor sensing a front end of the paper entering the fusing device at an inlet of the fusing device and a second sensor sensing a rear end of the paper leaving the fusing device at the outlet of the fusing device, and wherein the opening/closing member opens the outlet of the fusing device when the first sensor senses that the front end of the paper enters the fusing device and closes the outlet of the fusing device when the second sensor senses that the rear end of the paper leaves the fusing device.

16. The image forming apparatus according to claim 14, further comprising a cam member proximate to the opening/closing member rotating to cause the opening/closing member to open or close based on the result of the sensing the end of the paper.

* * * * *

UNITED STATES PATENT AND TRADEMARK OFFICE

CERTIFICATE OF CORRECTION

PATENT NO. : 7,792,453 B2
APPLICATION NO. : 12/153271
DATED : September 7, 2010
INVENTOR(S) : Sung Ku Baek et al.

It is certified that error appears in the above-identified patent and that said Letters Patent is hereby corrected as shown below:

Column 9, Line 41, delete “hingedlv” and insert --hingedly--, therefor.

Signed and Sealed this
Fourth Day of January, 2011

David J. Kappos

David J. Kappos
*Director of the United States Patent and Trademark Office*